US007862212B2

(12) United States Patent
Huang et al.

(10) Patent No.: US 7,862,212 B2
(45) Date of Patent: Jan. 4, 2011

(54) LIGHT EMITTING DIODE LENS STRUCTURE AND AN ILLUMINATION APPARATUS INCORPORATING WITH THE LED LENS STRUCTURE

(75) Inventors: Cheng-Yu Huang, Taoyuan County (TW); Te-Kai Ku, Hsinchu County (TW); Hsin-Kai Wang, Taipei County (TW)

(73) Assignee: Pacific Speed Limited, Wanchai (HK)

( * ) Notice: Subject to any disclaimer, the term of this patent is extended or adjusted under 35 U.S.C. 154(b) by 310 days.

(21) Appl. No.: 12/137,864

(22) Filed: Jun. 12, 2008

(65) Prior Publication Data

US 2009/0310366 A1 Dec. 17, 2009

(51) Int. Cl.
*F21V 7/00* (2006.01)

(52) U.S. Cl. ..... 362/299; 362/294; 362/555; 362/373; 362/249.01; 362/249.02

(58) Field of Classification Search ..... 362/299, 362/298, 347, 800, 255
See application file for complete search history.

(56) References Cited

U.S. PATENT DOCUMENTS

| | | | | |
|---|---|---|---|---|
| 6,504,301 | B1 * | 1/2003 | Lowery | 313/512 |
| 7,474,474 | B2 * | 1/2009 | Angelini et al. | 359/708 |
| 2002/0141196 | A1 * | 10/2002 | Camarota et al. | 362/372 |
| 2007/0236935 | A1 * | 10/2007 | Wang | 362/294 |

* cited by examiner

*Primary Examiner*—Sandra L O Shea
*Assistant Examiner*—Jessica L McMillan
(74) *Attorney, Agent, or Firm*—WPAT, P.C.; Anthony King

(57) ABSTRACT

A light emitting diode lens structure includes a lens having an upper section and a lower section. The lower section is provided with a light emitting diode accommodation part. The upper section is coated with a specular reflection layer to form a reflecting surface facing the light emitting diode accommodation part. An illumination apparatus with the light emitting diode lens structure includes a lampshade, a locking module, an electrode module, and a light emitting diode. The lampshade has a reflecting light surface and an aperture. The locking module is coupled on the lampshade and has a through hole corresponding to the aperture. The electrode module is coupled on the locking module and corresponds to the through hole. This design provides a significant reduction in glare to reduce eyestrain.

16 Claims, 8 Drawing Sheets

LIGHT EMITTING DIODE LENS STRUCTURE AND AN ILLUMINATION APPARATUS INCORPORATING WITH THE LED LENS STRUCTURE

BACKGROUND OF THE INVENTION

1. Field of the Invention

The present invention relates to a light emitting diode lens structure and an illumination apparatus incorporating with the light emitting diode lens structure, and more particularly to a light emitting diode lens structure and an illumination apparatus incorporating with the light emitting diode lens for anti-glare to reduce eyestrain 2. Description of the Prior Art There are many illumination apparatus in the market, such as fluorescent lamps, street lamps, desk lamps, and art lamps.

A conventional illumination apparatus uses a tungsten light bulb as the light source. Thanks to the science and technology to change with each passing day, a light emitting diode (LED) is applied to be a light source recently. Traffic signs, advertisement billboards, and vehicular lamps also use a light emitting diode as a light source. To use the LED as a light source is gradually popular because it saves power and provides more brightness.

A conventional LED illumination apparatus comprises a lampshade. The lampshade is provides with one or a plurality of light emitting diodes as a light source. The light emitting diode is coupled with a lens. By the transmission of the lens, the light from the light emitting diode radiates even and to a larger area in case the surface of the lens is ground glass. A conventional lens is designed to stress on transmission function, which is easy to cause glare and eyestrain.

Accordingly, the inventor of the present invention has devoted himself based on his many years of practical experiences to the development of an LED lens structure and an illumination apparatus incorporating with the LED lens structure for anti-glare to reduce eyestrain.

SUMMARY OF THE INVENTION

It is one object of the present invention to provide a light emitting diode lens structure comprising a lens having an upper section and a lower section. The lower section is provided with a light emitting diode accommodation part. The upper section is coated with a specular reflection layer to form a reflecting surface facing the light emitting diode accommodation part.

By the design of the reflecting surface and the reflecting surface facing the light emitting diode accommodation part, the light is reflected to provide an anti-glare lighting to reduce eyestrain.

It is another object of the present invention to provide an illumination apparatus incorporating with the LED lens structure includes a lampshade, a locking module, an electrode module, and a light emitting diode. The lampshade has a reflecting light surface and an aperture. The locking module is coupled on the lampshade and has a through hole corresponding to the aperture. The electrode module is coupled on the locking module and corresponds to the through hole.

The light emitting diode is assembled to the light emitting diode accommodation part of the lens, the lower section of the lens is inserted through the aperture and engages with the through hole, and the light emitting diode is electrically connected to the electrode module.

By the design of the reflecting surface and the reflecting surface facing the light emitting diode accommodation part, the light is reflected and radiated through the reflecting light surface of the lampshade to provide an anti-glare lighting to reduce eyestrain.

The lower section of the lens is formed with outer threads, the locking module is formed with inner threads, and the lower section of the lens is inserted through the aperture with the outer threads engaging with the inner threads.

DETAILED DESCRIPTION OF THE INVENTION

Figure 1:
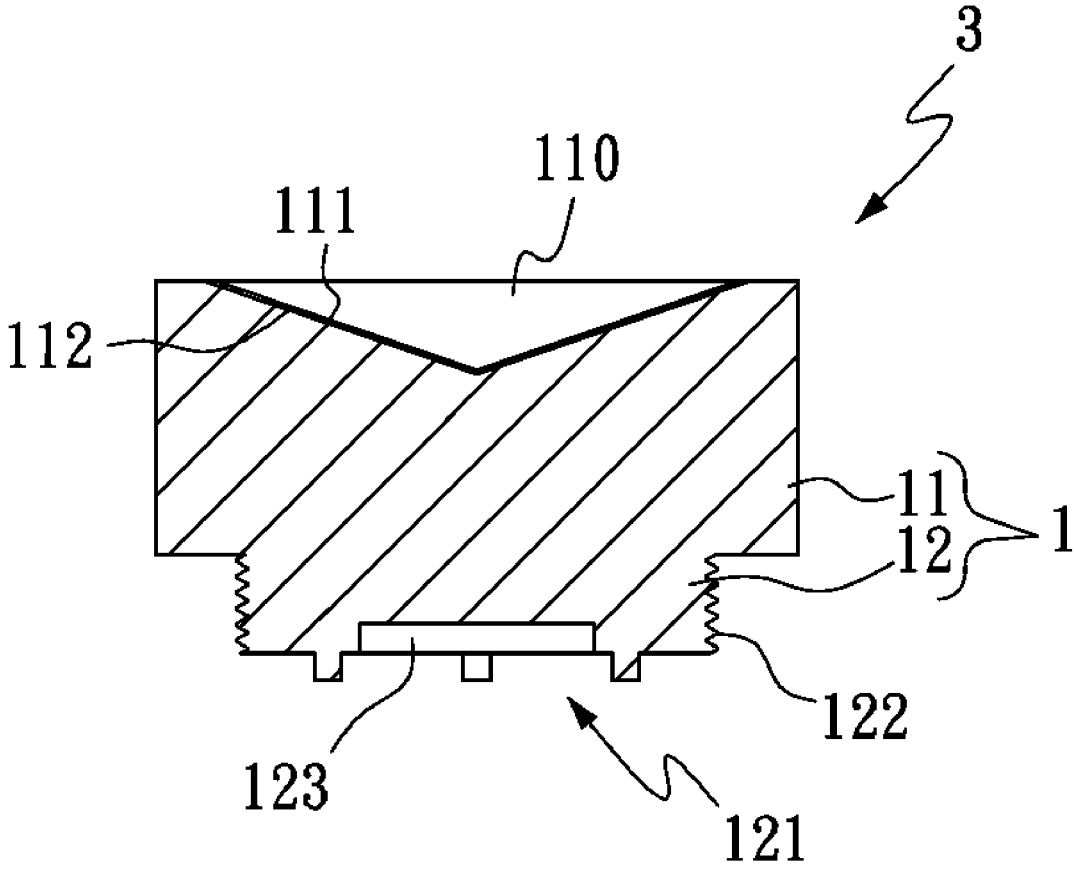
FIG. 1 is a cross-sectional view of a lens according to a first preferred embodiment of the present invention.

As shown in FIG. 1, a light emitting diode (LED) lens structure 3 according to a first preferred embodiment of the present invention comprises a lens 1 having an upper section 11 and a lower section 12. The lower section 12 has a light emitting diode (LED) accommodation part 121. The upper section 11 is coated with a specular reflection layer 111 to form a reflecting surface 112. The reflecting surface 112 faces the LED accommodation part 121.

In this embodiment, the upper section 11 of the lens 1 is formed with a concave part 110. The specular reflection layer 111 is coated on the concave part 110 to form the reflecting surface 112. In this embodiment, the concave part 110 has a taper cross-section, and the specular reflection layer 111 is an aluminum specular reflection layer. The specular reflection layer 111 may be other metallic coating layer with a reflecting light purpose to reflect light such as silver or oxide. The coating way is not limited, for example electroplating or sputtering.

In this embodiment, the upper section 11 of the lens 1 has a rectangular cross-section. The lower section 12 is formed with outer threads 122. The LED accommodation part 121 of the lower section 12 has a recess 123. The recess 123 has a rectangular cross-section.

In this embodiment, the lens 1 is in a circular shape. The shape of the lens 1 is not limited, which may be a rectangle or polygon.

Figure 2:
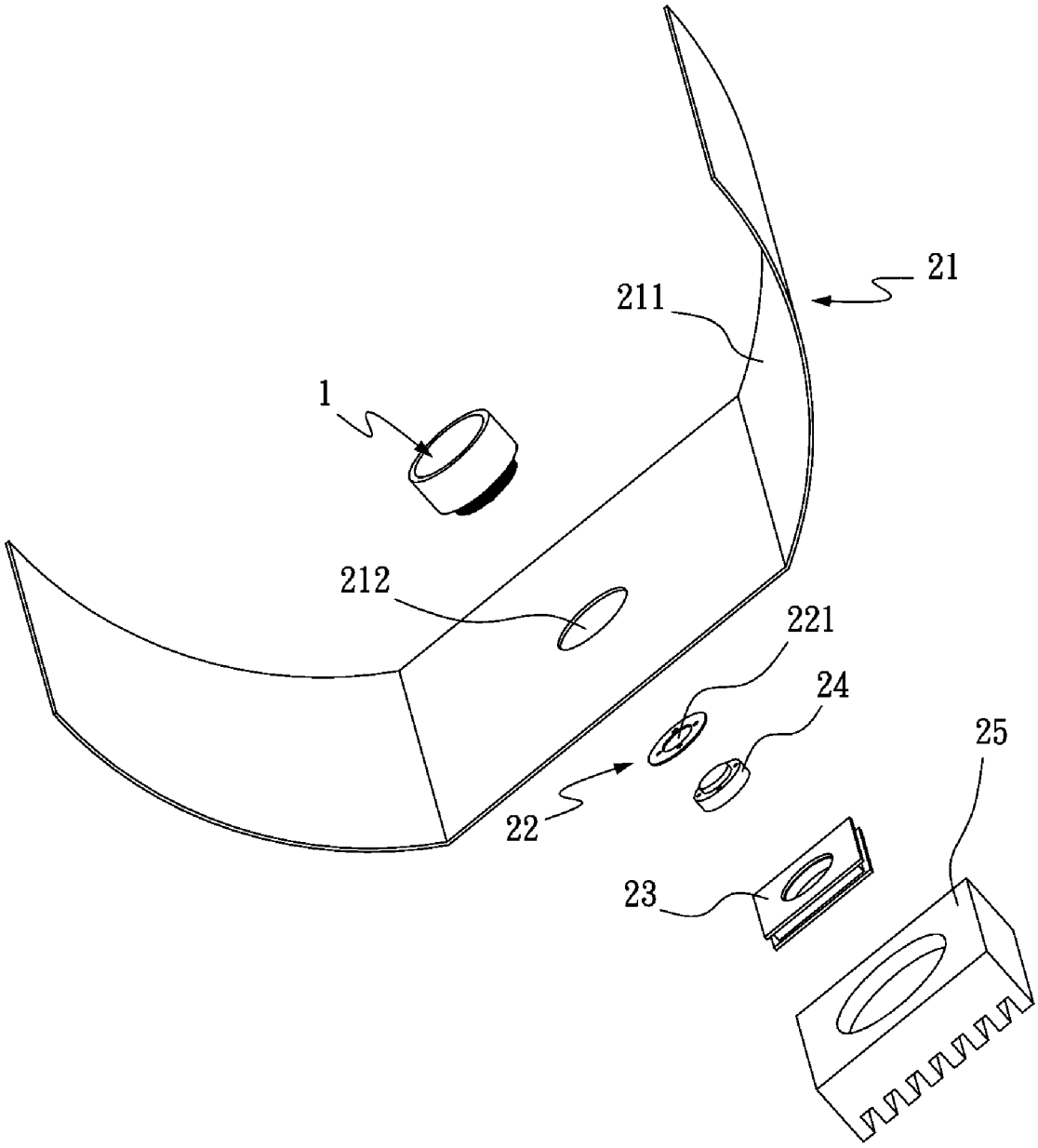
FIG. 2 is an exploded view of the lens according to the first preferred embodiment of the present invention incorporating with an illumination apparatus.
Figure 3:
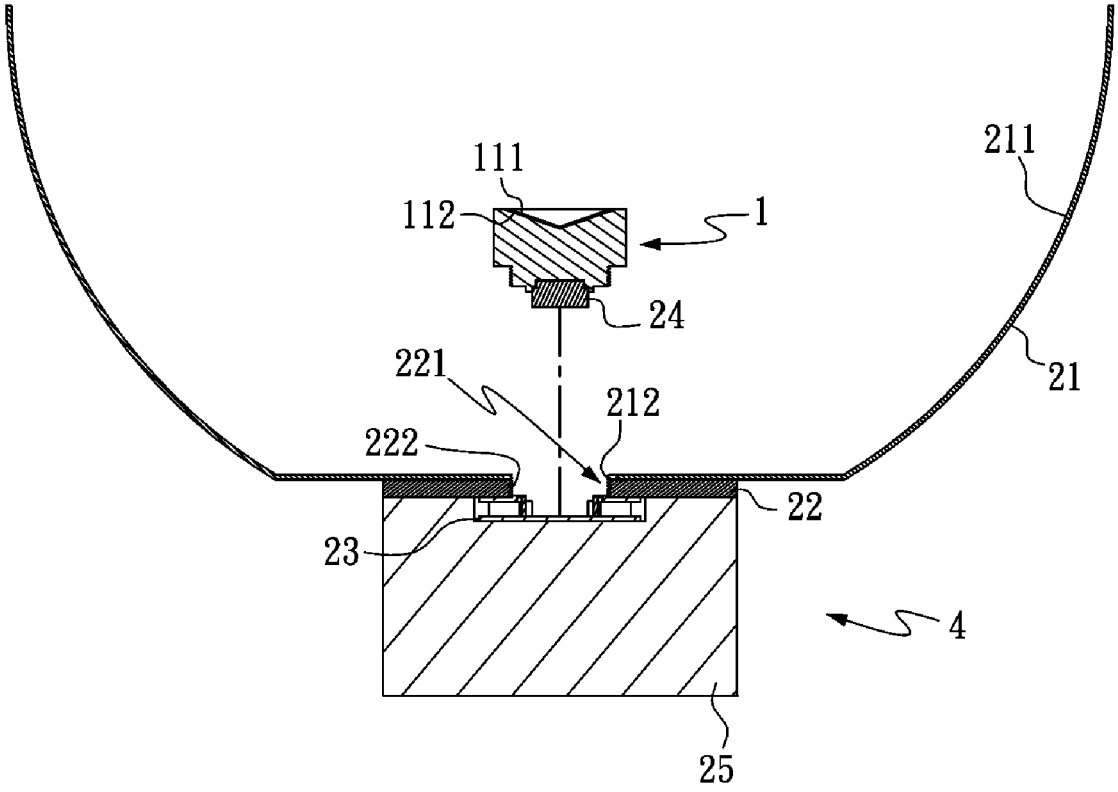
FIG. 3 is a cross-sectional view of the lens according to the first preferred embodiment of the present invention incorporating with the illumination apparatus.
Figure 4:
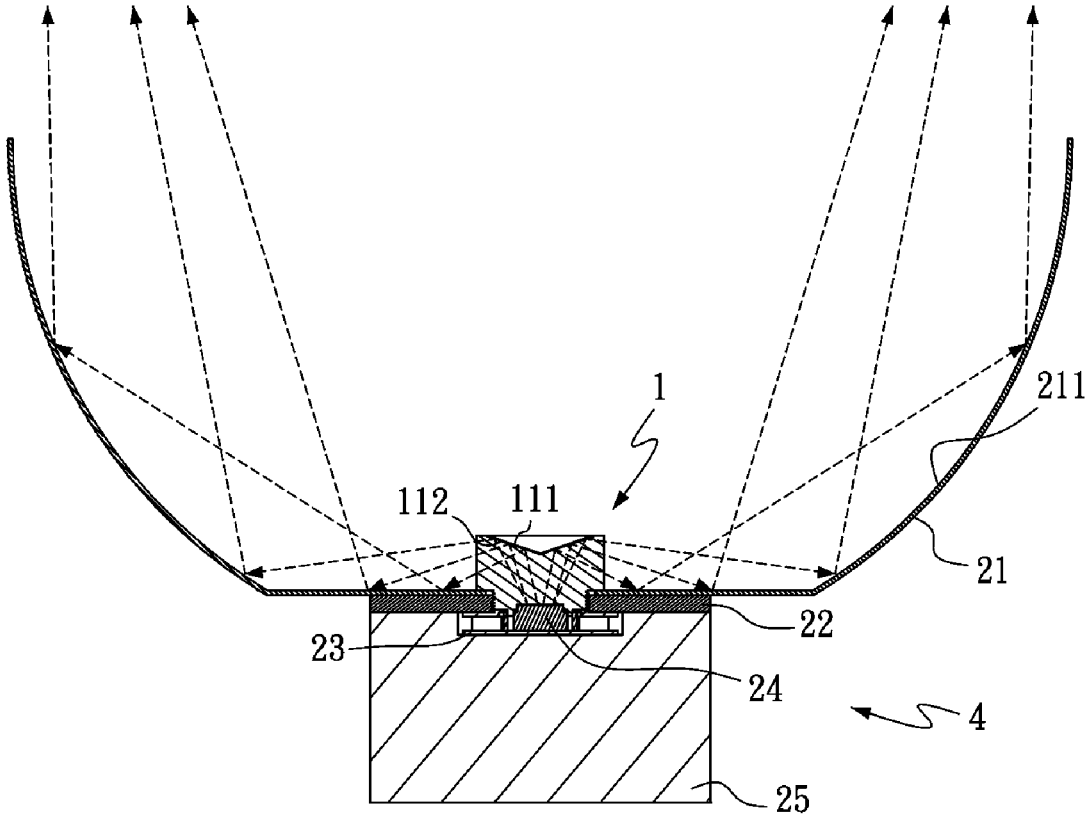
FIG. 4 is an assembled view of the lens according to the first preferred embodiment of the present invention incorporating with the illumination apparatus.

FIG. 2 is an exploded view of the lens according to the first preferred embodiment of the present invention incorporating with an illumination apparatus. FIG. 3 is a cross-sectional view of the lens according to the first preferred embodiment of the present invention incorporating with the illumination apparatus. FIG. 4 is an assembled cross-sectional view of the lens according to the first preferred embodiment of the present invention incorporating with the illumination apparatus. As shown in FIG. 1 through FIG. 4, the lens 1 is applied to an illumination apparatus 4. The illumination apparatus 4 comprises a lampshade 21, a locking module 22, 10 an electrode module 23, a light emitting diode (LED) 24, and a radiating heat module 25.

The lampshade 21 has a reflecting light surface 211 and an aperture 212. The reflecting light surface 211 faces and surrounds the aperture 212. The locking module 22 is mounted on the lampshade 21. The locking module 22 has a through hole 221 corresponding in position to the aperture 212. The radiating heat module 25 is mounted on the locking module 22 and is contact with the electrode module 23.

The light emitting diode 24 is assembled to the light emitting diode accommodation part 121 of the lens 1, the lower section 12 of the lens 1 is inserted through the aperture 212 and engages with the through hole 221, and the light emitting diode 24 is electrically connected to the electrode module 23.

In this embodiment, the LED 24 is attached to the LED accommodation part 121 of the lens 1, which may be done by other equivalent ways. For instance, the LED 24 is tightly embedded in the LED accommodation part 121.

In this embodiment, the lower section 12 has the outer threads 122, and the through hole 221 of the locking module 22 is formed with inner thread 222. The lower section 12 is inserted through the aperture 212 with the outer threads 122 engaging with the inner threads 222. The LED 24 is assembled to the LED accommodation part 121 of the lens 1. The lens 1 with the LED 24 is manually screwed to the through hole 221.

By the design of the reflecting surface 112 of the lens 1 and the reflecting surface 112 facing the LED accommodation part 121, the light from the LED 24 is refracted and radiated outward through the reflecting light surface 211 of the lampshade 21 to provide an anti-glare lighting to reduce eyestrain.

As shown in FIG. 4, the light from the LED 24 is radiated upward and reflected downward through the reflecting surface 112 of the lens 1, and finally sent out through the reflecting light surface 211 of the lampshade 21 to provide an anti-glare lighting to reduce eyestrain. The light from the LED 24 of the present invention is comfortable to the eyes, not like a conventional light which is lighting outwardly directly so as to be easy to cause glare and eyestrain.

By the design of the outer threads 122 engaging with the inner threads 222, the LED 24 is able to be replaced when it is damaged, which is convenient to maintenance. The lampshade 21 may be provided with a plurality of lenses 1 with a plurality of light emitting diodes 24. When one of the light emitting diodes 24 is damaged, it is able to replace the LED 24 manually.

A conventional LED structure is to fix the foot of the LED direct, which is unable to make a replacement. Contrary, it is quick to replace the LED 24 with the outer threads 122 engaging with the inner threads 222 without concerning the electrode. When the lens 1 is connected with the LED 24, the LED 24 is electrically connected to the electrode 23 direct. This design is very convenient to assemble and disassemble the present invention.

Figure 5:
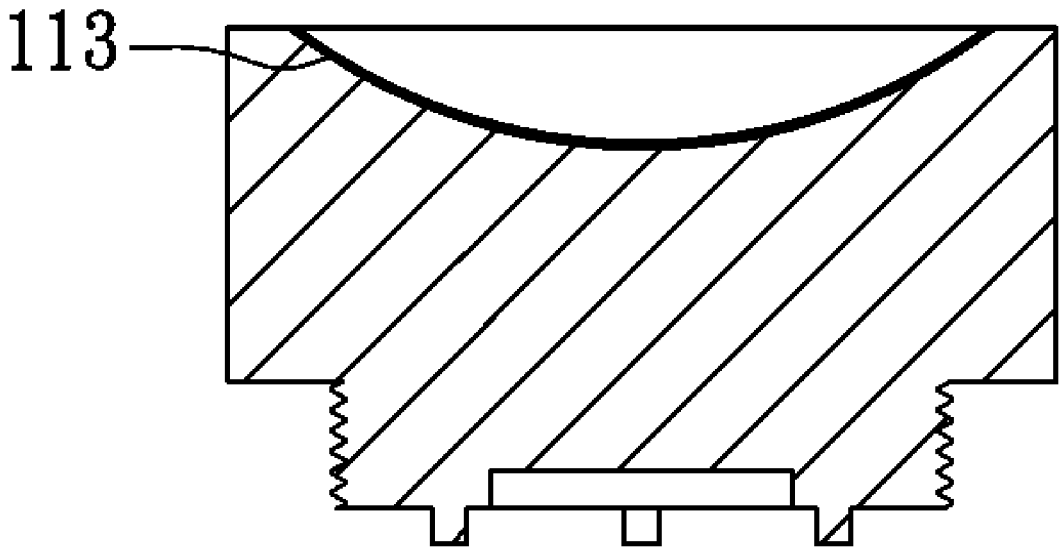
FIG. 5 is a cross-sectional view of a second preferred embodiment of the present invention.

FIG. 5 is a cross-sectional view of a lens according to a second preferred embodiment of the present invention. The second preferred embodiment is substantially similar to the first preferred embodiment with the exception described hereinafter. The reflecting surface 113 has an arc cross-section.

Figure 6:
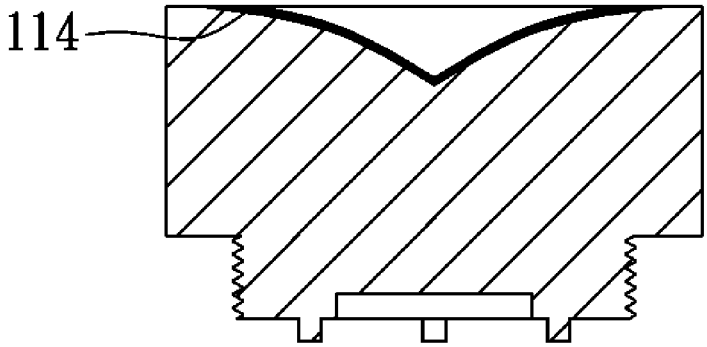
FIG. 6 is a cross-sectional view of a third preferred embodiment of the present invention.

FIG. 6 is a cross-sectional view of a lens according to a third preferred embodiment of the present invention. The third preferred embodiment is substantially similar to the first preferred embodiment with the exception described hereinafter. The reflecting surface 114 has an arc and taper cross-section.

Figure 7:
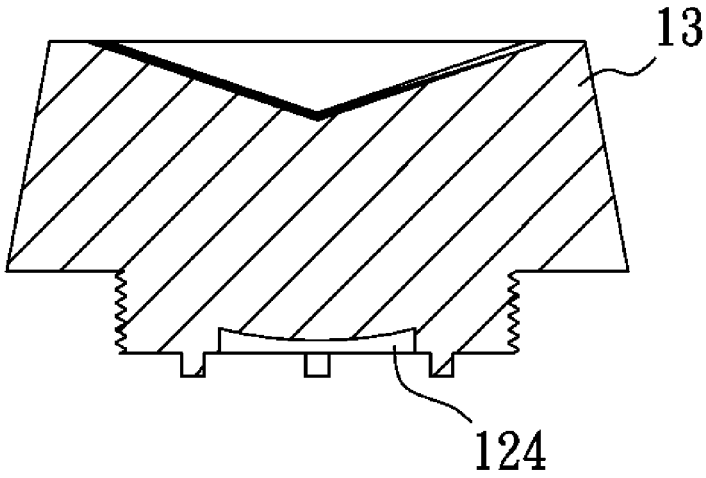
FIG. 7 is a cross-sectional view of a fourth preferred embodiment of the present invention.

FIG. 7 is a cross-sectional view of a lens according to a fourth preferred embodiment of the present invention. The fourth preferred embodiment is substantially similar to the first preferred embodiment with the exceptions described hereinafter. The upper section 13 has a trapezoid cross-section, and the recess 124 has a concave cross-section.

Figure 8:
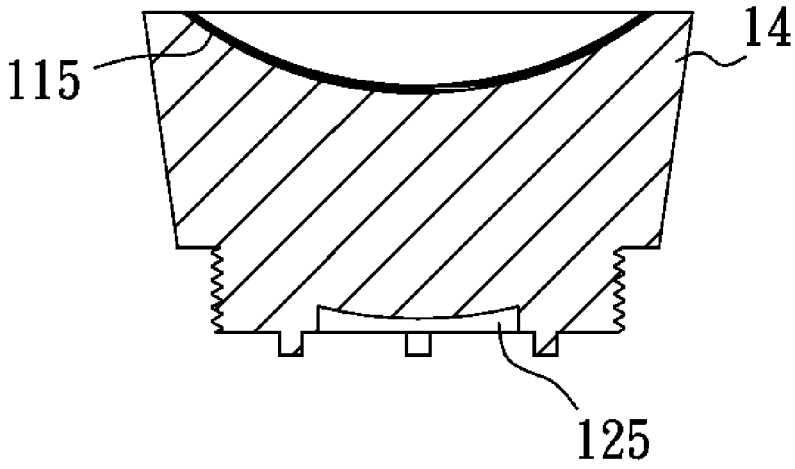
FIG. 8 is a cross-sectional view of a fifth preferred embodiment of the present invention.

FIG. 8 is a cross-sectional view of a lens according to a fifth preferred embodiment of the present invention. The fifth preferred embodiment is substantially similar to the first preferred embodiment with the exceptions described hereinafter. The upper section 14 has a trapezoid cross-section, the reflecting surface 115 has an arc cross-section, and the recess 125 has a concave cross-section.

Figure 9:
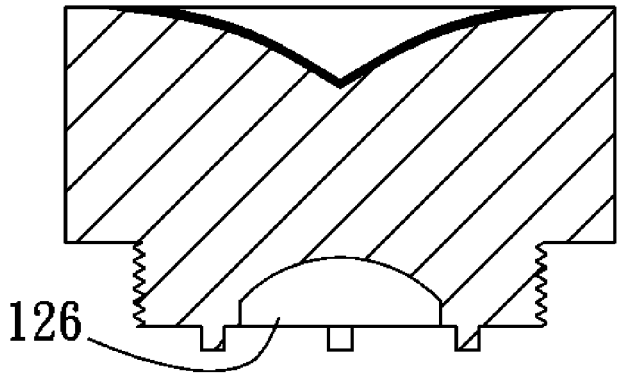
FIG. 9 is a cross-sectional view of a sixth preferred embodiment of the present invention.

FIG. 9 is a cross-sectional view of a lens according to a sixth preferred embodiment of the present invention. The sixth preferred embodiment is substantially similar to the first and third preferred embodiment with the exception described hereinafter. The recess 126 has a convex cross-section.

According to the above-described embodiments, the shapes of the upper section, the reflecting surface, and the recess are not limited. Various shapes have the same effect as the first preferred embodiment.

Figure 10:
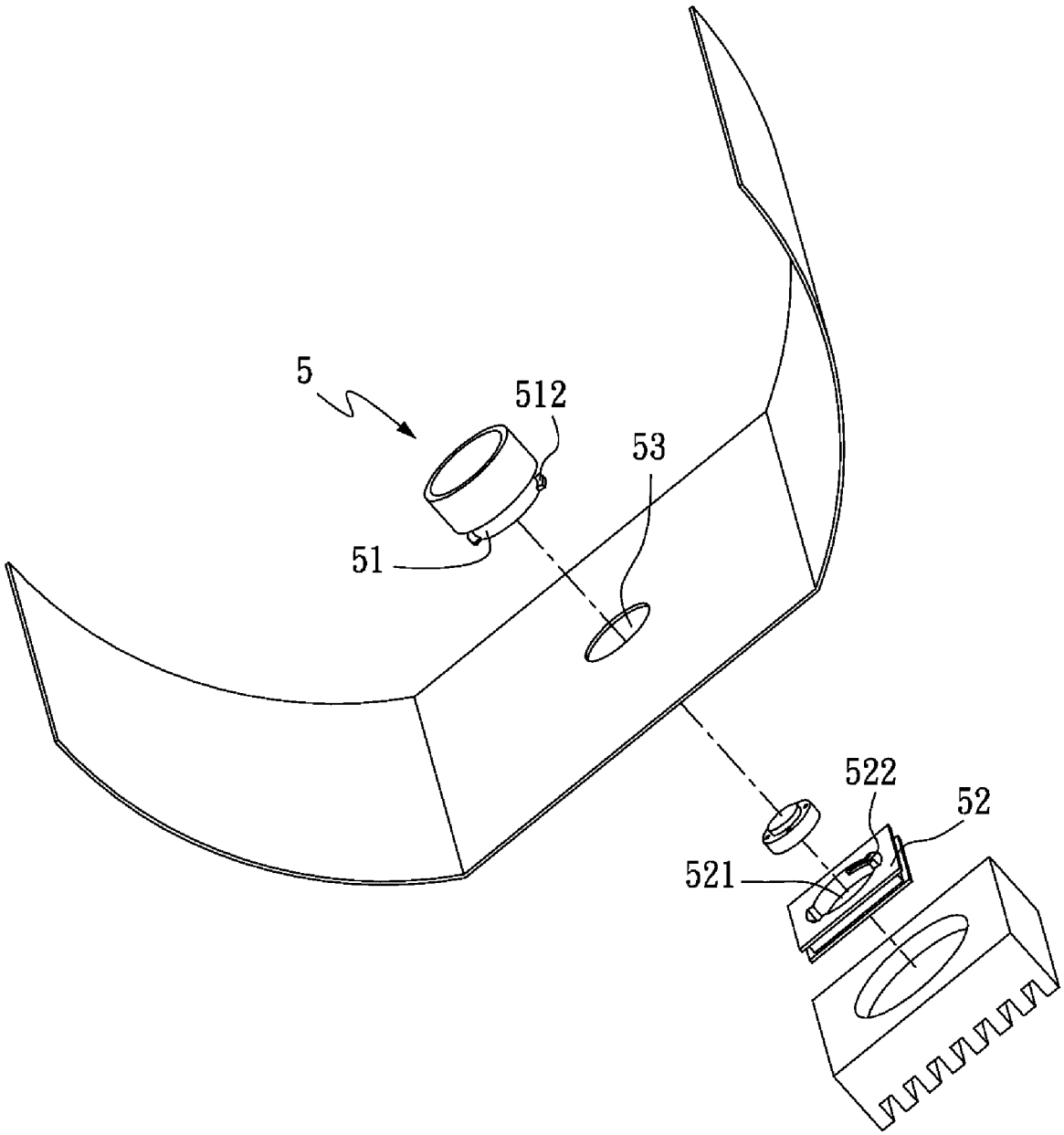
FIG. 10 is an exploded view of a seventh preferred embodiment of the present invention incorporating with the illumination apparatus.

FIG. 10 is an exploded view of a lens according to the seventh preferred embodiment of the present invention incorporating with the illumination apparatus. The seventh preferred embodiment is substantially similar to the first preferred embodiment with the exceptions described hereinafter. The lower section 51 of the lens 5 is provided with a first engaging part 512, and the through hole 521 of the electrode 10 module 52 is formed with a second engaging part 522. The lower section 51 of the lens 5 is inserted through the aperture 53, with the first engaging part 512 engaging with the second engaging part 522. This design of engagement has the same effect as the above-described preferred embodiments.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A light emitting diode lens structure, comprising a lens having an upper section and a lower section, said lower section being provided with a light emitting diode accommodation part, said upper section being coated with a specular reflection layer to form a reflecting surface, said reflecting surface facing said light emitting diode accommodation part.

2. The light emitting diode lens structure as claimed in claim 1, wherein said lower section is formed with outer threads.

3. The light emitting diode lens structure as claimed in claim 1, wherein said lower section is formed with a pair of engaging parts.

4. The light emitting diode lens structure as claimed in claim 1, wherein said upper section is formed with a concave part, and said specular reflection layer is coated on said concave part to form said reflecting surface.

5. The light emitting diode lens structure as claimed in claim 1, wherein said reflecting surface has a taper cross-section.

6. The light emitting diode lens structure as claimed in claim 1, wherein said reflecting surface has an arc cross-section.

7. The light emitting diode lens structure as claimed in claim 1, wherein said upper section has a rectangular cross-section.

8. The light emitting diode lens structure as claimed in claim 1, wherein said upper section has a trapezoid cross-section.

9. The light emitting diode lens structure as claimed in claim 1, wherein said light emitting diode accommodation part has a recess.

10. The light emitting diode lens structure as claimed in claim 9, wherein said recess has a rectangular cross-section.

11. The light emitting diode lens structure as claimed in claim 9, wherein said recess has a concave cross-section.

12. The light emitting diode lens structure as claimed in claim 1, wherein said specular reflection layer is an aluminum specular reflection layer.

13. An illumination apparatus incorporating with the light emitting diode lens structure as claimed in claim 1, comprising:

a lampshade having a reflecting light surface and an aperture;

a locking module coupled on said lampshade, said locking module having a through hole corresponding to said aperture;

an electrode module coupled on said locking module and corresponding to said through hole;

a radiating heat module coupled on said locking module and being in contact with said electrode module; and a light emitting diode;

wherein said light emitting diode is assembled to said light emitting diode accommodation part of said lens, said lower section of said lens is inserted through said aperture and engages with said through hole, and said light emitting diode is electrically connected to said electrode module.

14. The illumination apparatus as claimed in claim 13, wherein said light emitting diode is attached to said light emitting diode accommodation part.

15. The illumination apparatus as claimed in claim 13, wherein said lower section of said lens is formed with outer threads and said through hole of said locking module is formed with inner threads, and said lower section of said lens is inserted through said aperture with said outer threads engaging with said inner threads.

16. The illumination apparatus as claimed in claim 13, wherein said lower section of said lens is formed with a first engaging part and said locking module is formed with a second engaging part, and said lower section of said lens is inserted through said aperture with said first engaging part engaging with said second engaging part.

* * * * *